US005782471A

United States Patent [19]

Bautista et al.

[11] Patent Number: 5,782,471

[45] Date of Patent: Jul. 21, 1998

[54] BOARD GAME APPARATUS AND METHOD OF PLAY

[76] Inventors: Jacqueline Bautista; Angel B. Bautista, both of 77 Brothers Rd., Wappingers Falls, N.Y. 12590

[21] Appl. No.: 867,399

[22] Filed: Jun. 2, 1997

[51] Int. Cl.[6] ..... A63F 3/00

[52] U.S. Cl. ..... 273/256; 273/272; 434/191; 434/209

[58] Field of Search ..... 273/272, 256, 273/243, 249; 434/209, 191

[56] References Cited

U.S. PATENT DOCUMENTS

| | | | |
|---|---|---|---|
| D. 331,949 | 12/1992 | Richardson et al. | D21/31 |
| D. 333,847 | 3/1993 | Redding | D21/31 |
| 3,104,106 | 9/1963 | Kenney et al. | 273/248 |
| 4,029,320 | 6/1977 | Hausman | 273/249 |
| 4,109,918 | 8/1978 | Mele et al. | 273/256 |
| 4,561,658 | 12/1985 | Peterson | 273/243 |
| 4,714,254 | 12/1987 | Calloway | 273/249 |
| 4,932,666 | 6/1990 | Corle | 273/249 |
| 4,988,108 | 1/1991 | Shepard | 273/254 |
| 5,102,339 | 4/1992 | Parriera | 434/191 |
| 5,318,447 | 6/1994 | Mooney | 434/128 |
| 5,405,140 | 4/1995 | Terlinden et al. | 273/251 |
| 5,445,390 | 8/1995 | Dutton et al. | 273/243 |

FOREIGN PATENT DOCUMENTS

| | | | |
|---|---|---|---|
| 2198361 | 6/1988 | United Kingdom | 273/249 |
| 2205762 | 12/1988 | United Kingdom | 273/249 |

*Primary Examiner*—Benjamin H. Layno
*Attorney, Agent, or Firm*—Richard C. Litman

[57] ABSTRACT

The present invention comprises a board game for teaching basic arithmetic and mathematical operations to small children and others in need of such skills. The game board includes a continuous rectangular peripheral playing path having a series of playing positions therealong, with each of the positions requiring a player to accept or pay out an amount of simulated currency. The goal is for a player to reach a predetermined monetary total, whereupon the player may purchase an imaginary "dream trip" with the accrued money. For very young persons beginning to learn basic addition and subtraction, this first level of the game may be sufficient. However, the present game also provides higher levels, in which players are required to perform some higher mathematical operation using a random number generation device (dice, etc.) to provide the numbers to be manipulated mathematically, before being able to advance along the playing path. Play proceeds as described above for each level, with the first player who accrues the predetermined amount of currency and purchasing a "dream trip" winning that level or round of the game.

15 Claims, 7 Drawing Sheets

28a

| | | | | | |
|---|---|---|---|---|---|
| 3 | PLUS | 1 | EQUAL | 4 |
| 3 | PLUS | 2 | EQUAL | 5 |
| 3 | PLUS | 3 | EQUAL | 6 |
| 3 | PLUS | 4 | EQUAL | 7 |
| 3 | PLUS | 5 | EQUAL | 8 |
| | ⋮ | | ⋮ | |
| 3 | PLUS | 10 | EQUAL | 13 |
| 3 | PLUS | 11 | EQUAL | 14 |
| 3 | PLUS | 12 | EQUAL | 15 |
| 3 | TIMES | 1 | EQUAL | 3 |
| 3 | TIMES | 2 | EQUAL | 6 |
| 3 | TIMES | 3 | EQUAL | 8 |
| 3 | TIMES | 4 | EQUAL | 12 |
| | ⋮ | | ⋮ | |
| 3 | TIMES | 10 | EQUAL | 30 |
| 3 | TIMES | 11 | EQUAL | 33 |
| 3 | TIMES | 12 | EQUAL | 36 |

28b

BOARD GAME APPARATUS AND METHOD OF PLAY

BACKGROUND OF THE INVENTION

1. Field of the Inventon

The present invention relates generally to games involving elements of chance and skill, and more particularly to a board game for teaching and enforcing basic arithmetic and mathematical skills in children and others. The game comprises a board having a peripheral playing path containing instructions which result in the gain or loss of simulated currency by players as they travel the game board path. The game (or a given level or stage of the game) is ended when one player accrues a predetermined amount of the simulated currency and exchanges it for an imaginary or "dream trip," or when one player becomes insolvent. Higher levels or stages of the game involve the answering of arithmetic questions or problems, or the working of mathematical operations, by players before they are allowed to advance along the playing path.

2. Description of the Related Art

Arithmetic and mathematical skills are often difficult for children to acquire. The abstract use and manipulation of numbers is not generally an inherently obvious operation to most children, and the application of such operations to something which they can readily see or use, is often of great assistance in teaching basic arithmetic and mathematics to children and others.

One means of teaching such skills to children is through the use of a game developed for such purposes. Games have long been used not only as recreational activities, but various games have been developed which may teach children and others various skills which may be needed in the course of their lives. The playing of an appropriate game is a relatively "painless" means of learning some skill or activity, and accordingly, various games providing for the teaching of some skill or the like, have been developed in the past. However, such games differ from the present board game in various ways, as will be pointed out below in the discussion of the related art of which the present inventors are aware.

U.S. Pat. No. 3,104,106 issued on Sep. 17, 1963 to James T. Kenney et al. describes an Arithmetical Teaching Aid Game comprising a game board having a peripheral playing path with branches extending inwardly therefrom. Players must solve various fractional arithmetic problems, but assistance is provided in the form of semicircular segments comprising fractions of a circle, with which players may work out solutions to various problems. The Kenney et al. game is more akin to a race, as players must complete one circuit of the board and then proceed to the end of one of the branch paths to win the game. The present game does not require the completion of any specific distance along the playing path, but provides simulated currency and rewards the first player to accrue a predetermined sum of currency with a "dream trip." Also, Kenney et al. provide only one level of play, while the present game may provide up to three different levels of increasing difficulty.

U.S. Pat. No. 4,932,666 issued on Jun. 12, 1990 to Kenneth R. Corle describes a Method Of Playing A Travel Board Game. The object of the game is more closely related to that of the Kenney et al. game discussed immediately above than to the present game, in that the winner is the first player to complete the entire playing path disposed upon the board. Corle mentions the determination of the winner as the player having the greatest amount of simulated currency at the end of the game, but still requires all players to reach the final playing position on the board. This is not a required part of the present game. Geographical (not arithmetic or mathematical) questions are asked of players during the course of the game, and rewards or penalties of playing position or simulated currency are imposed. No positional or financial penalties are imposed for incorrect answers in the present game, other than that an incorrect answer precludes the player from advancing. Corle provides only a single level of play in his game, unlike the three levels of increasing difficulty provided in the present game.

U.S. Pat. No. 4,988,108 issued on Jan. 29, 1991 to Howard F. Shepard describes a Question And Answer Geography Board Game comprising a map of a specific geopolitical area and a corresponding peripheral playing path. Players travel the path and answer questions about areas on the board corresponding to their particular location along the path. Points are awarded for correct answers. No simulated currency or different levels of play are provided by Shepard, as are provided for the play of the present game.

U.S. Pat. No. 5,102,339 issued on Apr. 7, 1992 to Larry L. Parriera describes a Mathematical Education Game comprising a plurality of parallel paths on a board. Each of the paths has a starting point, an end point, and a series of mathematical symbols thereon, directing players to perform mathematical operations according to the specific symbol when they alight on a position containing such a symbol. The first player to pass the end point of his or her playing path is the winner. No simulated financial or travel rewards are given to the players, nor are any different levels of play provided, as are provided by the present game.

U.S. Pat. No. 5,405,140 issued on Apr. 11, 1995 to Joyce A. Terlinden et al. describes a Family Vacation Board Game including a geopolitical map of the United States with a plurality of separate playing paths thereacross. The object of the game is to answer geographical questions correctly in order to advance playing pieces along a round trip over the routes and back to the starting position. The game is thus a "race" type game, with the first player to reach the start/end position exactly, being the winner. No mathematical operations are required during the course of play of the Terlinden et al. game, while the present game requires such operations in order for players to advance. Terlinden et al. do not provide different levels of increasing difficulty in their game, while the present game provides such levels as an option for players as agreed upon before the start of the game.

U.S. Pat. No. D-331,949 issued on Dec. 22, 1992 to Adelbert E. Richardson et al. illustrates a design for a Game Board having a periphery containing the two letter postal identifiers for the forty eight contiguous U.S. states. No mathematical symbols are shown on the board, and no means for accomplishing mathematical operations or method of play is described.

U.S. Pat. No. D-333,847 issued on Mar. 9, 1993 to Kinney Redding illustrates a Game Board having an unmarked peripheral playing path and apparently a representation of the earth in the center thereof. No mathematical symbols, means for accomplishing mathematical operations, or method of play is disclosed.

British Pat. Publication No. 2,198,361 published on Jun. 15, 1988 to John Powell describes an Educational Game directed to teaching children of the potential dangers of child molestation. Play proceeds about a continuous looped path in a "race" format, with the winner being the first player to reach the starting point after completing the path. No mathematical operations or simulated award or currency is provided, as provided in the present game.

Finally, British Pat. Publication No. 2,205,762 published on Dec. 21, 1988 to Christopher E. Murphy et al. describes a Board Game comprising a convoluted playing path simulating a boat canal. Players compete to travel portions of the path to different points, simulating the pickup, carriage, and delivery of cargo along the canal. This is a "race" game, with the first player to complete the designated path being the winner. No mathematical operations are provided or required in the play of the game.

None of the above inventions and patents, taken either singly or in combination, is seen to describe the instant invention as claimed.

SUMARY OF THE INVENTION

The present invention comprises a board game for teaching basic arithmetic and mathematical operations to small children and others in need of such skills. The game board includes a continuous rectangular peripheral playing path having a series of playing positions therealong, with each of the positions requiring a player to accept or pay out an amount of simulated currency. The goal is for a player to reach a predetermined monetary total, whereupon the player may purchase an imaginary "dream trip" with the accrued money. For very young persons beginning to learn basic addition and subtraction, this first level of the game may be sufficient. However, the present game also provides higher levels, in which players are required to perform some higher mathematical operation using random number generation means to provide the numbers to be manipulated mathematically, before being able to advance along the playing path. Play proceeds as described above for each level, with the first player who accrues the predetermined amount of currency and purchasing a "dream trip" winning that level or round of the game. Alternatively, each level of the game is ended when one of the players is "bankrupt," and has paid out all of his or her simulated currency.

Accordingly, it is a principal object of the invention to provide an improved board game including means of teaching basic arithmetic and mathematical skills to the players thereof.

It is another object of the invention to provide an improved board game which includes a game board having a peripheral path comprising a plurality of separate playing positions, each of which requires the acceptance or payout of an amount of simulated currency by a player terminating a move upon the given position.

It is a further object of the invention to provide an improved board game wherein the first player to accrue a predetermined amount of currency may purchase an imaginary trip, thereby winning the game.

An additional object of the invention is to provide an improved board game in which optional additional levels are provided, which require players to perform some arithmetic or mathematical operation before proceeding.

Still another object of the invention is to provide an improved board game including random number generating means to provide players with the numbers for such arithmetic or mathematical operation.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a board game for two or more players, for teaching children and others the basics of arithmetic and mathematical operations, such as addition, subtraction, and multiplication. The game is structured with up to three levels, so very small children just beginning to have a grasp of numbers may still learn the basic concepts of addition and subtraction, yet more advanced children and players may proceed to levels which demand somewhat more knowledge of arithmetic.

Figure 1:
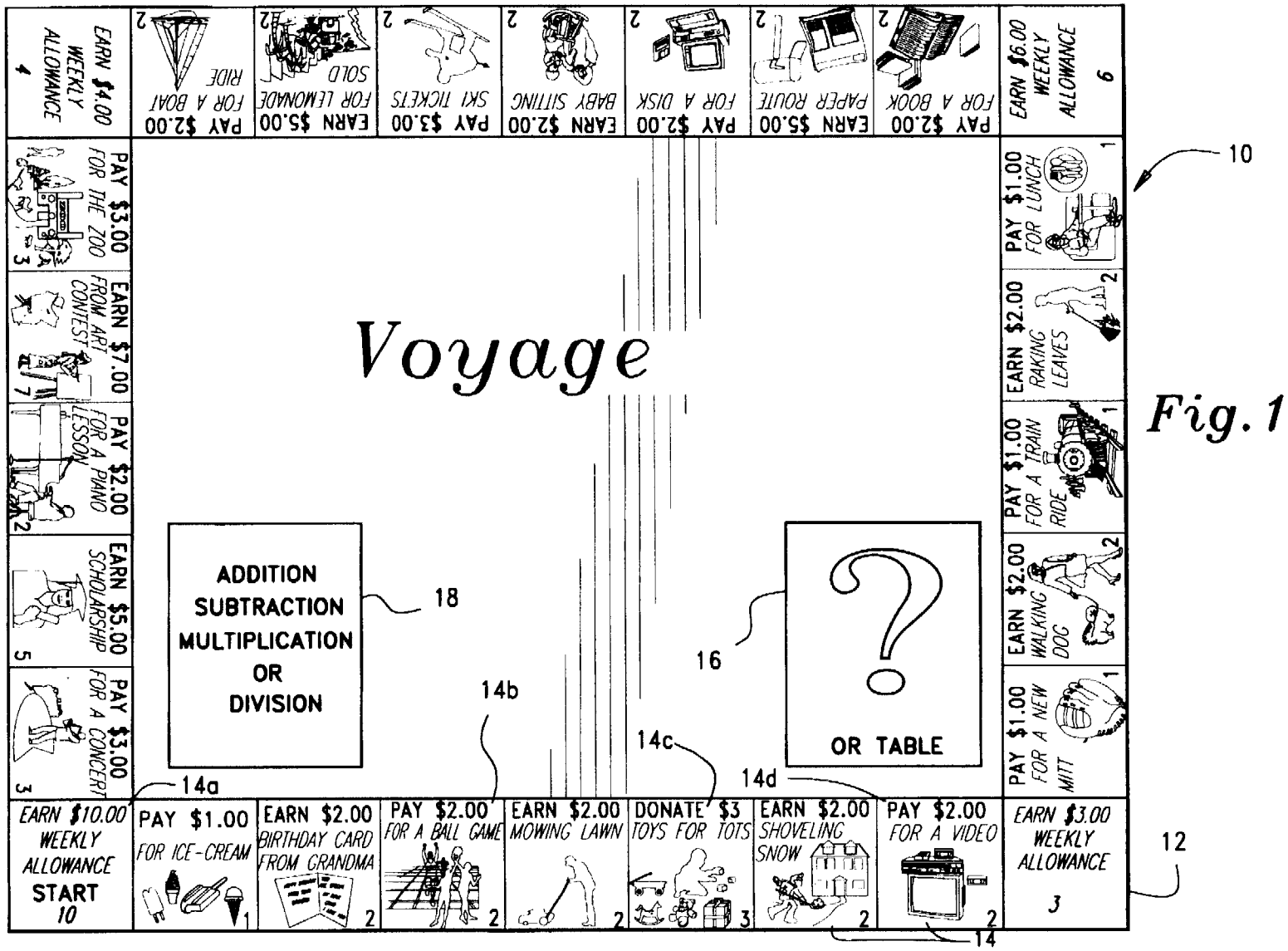
FIG. 1 is a plan view of the game board of the present board game, showing the peripheral playing path and other features thereof.
Figure 2:
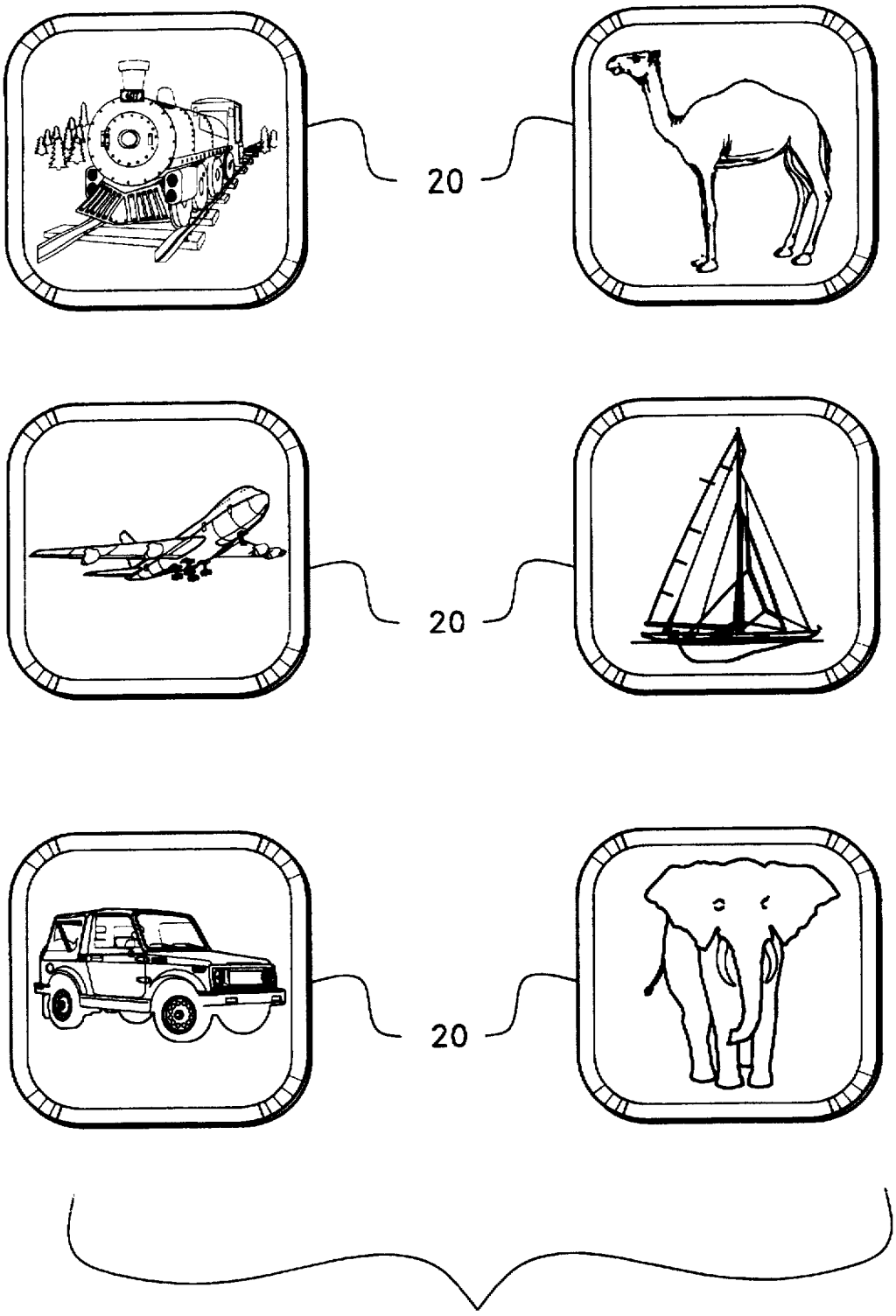
FIG. 2 is a plan view of a plurality of player position markers used in the play of the present game.

FIG. 1 discloses the game board 10 used in the play of the game. The game board 10 has a continuous peripheral playing path 12 comprising a series of contiguous individual playing positions, generally indicated by the reference numeral 14. Each playing position 14 includes some instruction thereon, instructing a player to make a monetary transaction of some sort depending upon the specific playing position upon which the player's move terminates. All play is started from the start position **14*a***, with each player receiving $10.00 as a simulated "allowance" to begin the game.

The remaining playing positions each include some instruction providing payment in some form to the player, e. g., "Earn $2.00, Birthday card from Grandma" as indicated at the position **14*b*, or to make a payment of some sort, e. g., "Donate $3, Toys for Tots" as indicated at the position 14*c*. Thus, all of the positions 14 may be divided into two groups, with a first group (e.g., position 14*b*) rewarding the player with payment of some sort, and a second group (e. g., position 14*c***) requiring payment from the player.

Figures 4A, 4B:
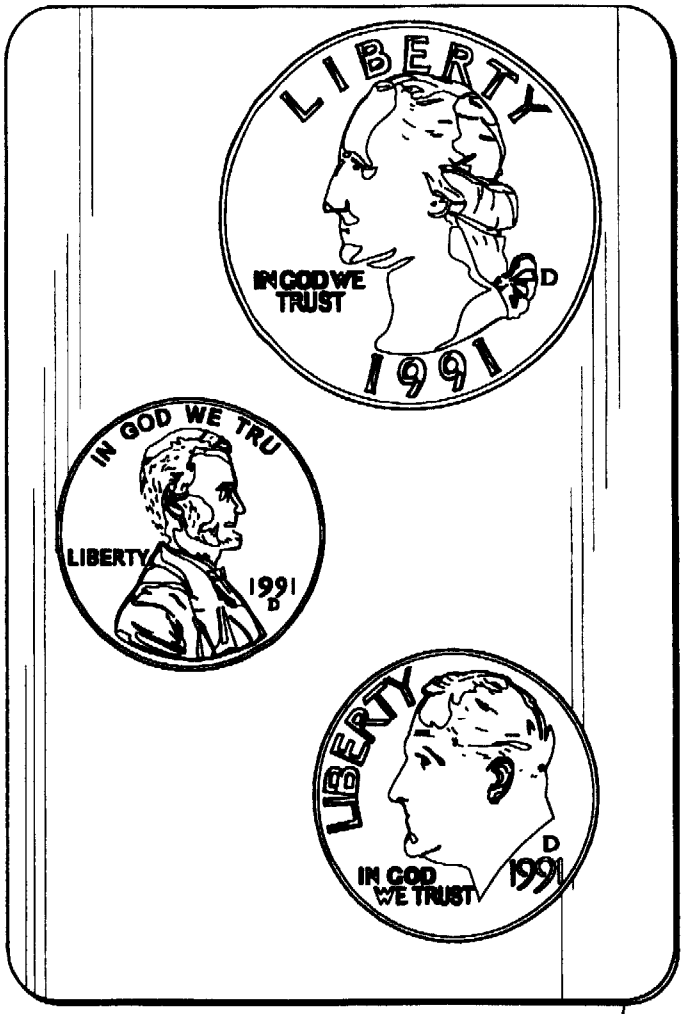
FIG. 4A is a front view of an exemplary mathematical table card used in second level play of the present game.
FIG. 4B is a back view of the card of FIG. 4A.
Figure 5B:
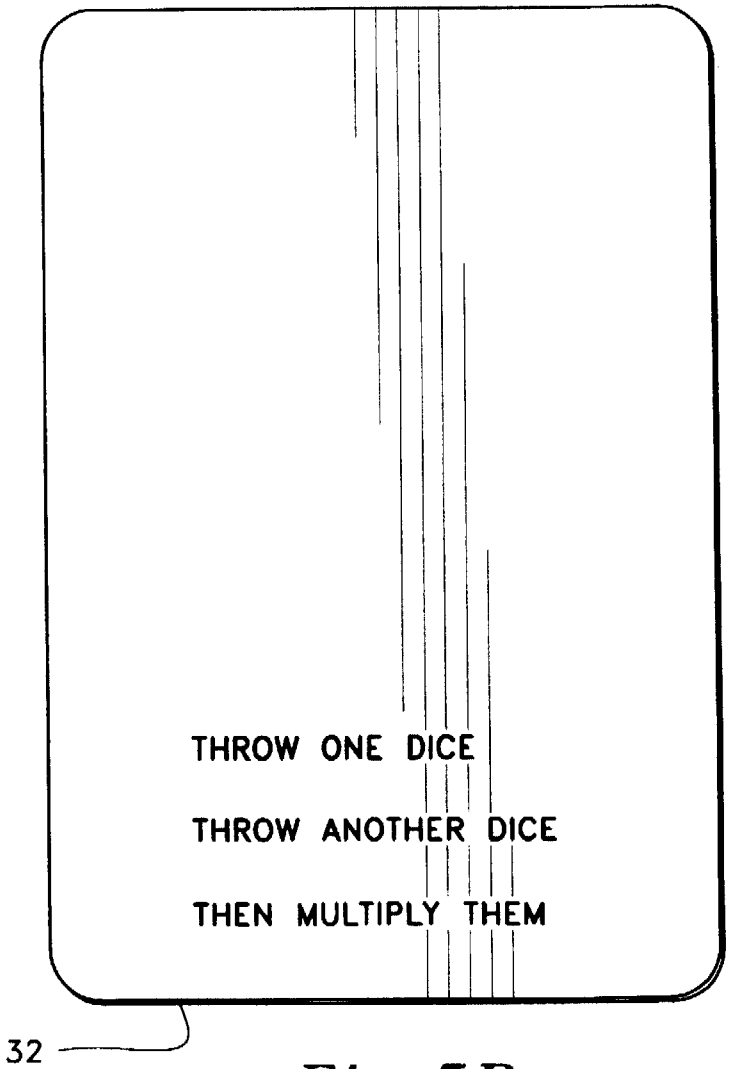
FIG. 5B is a view of an exemplary mathematical operation card used in third level play of the present game, with the views of FIGS. 5A and 5B being adapted for placement on opposite faces of the same card.
Figure 5A:
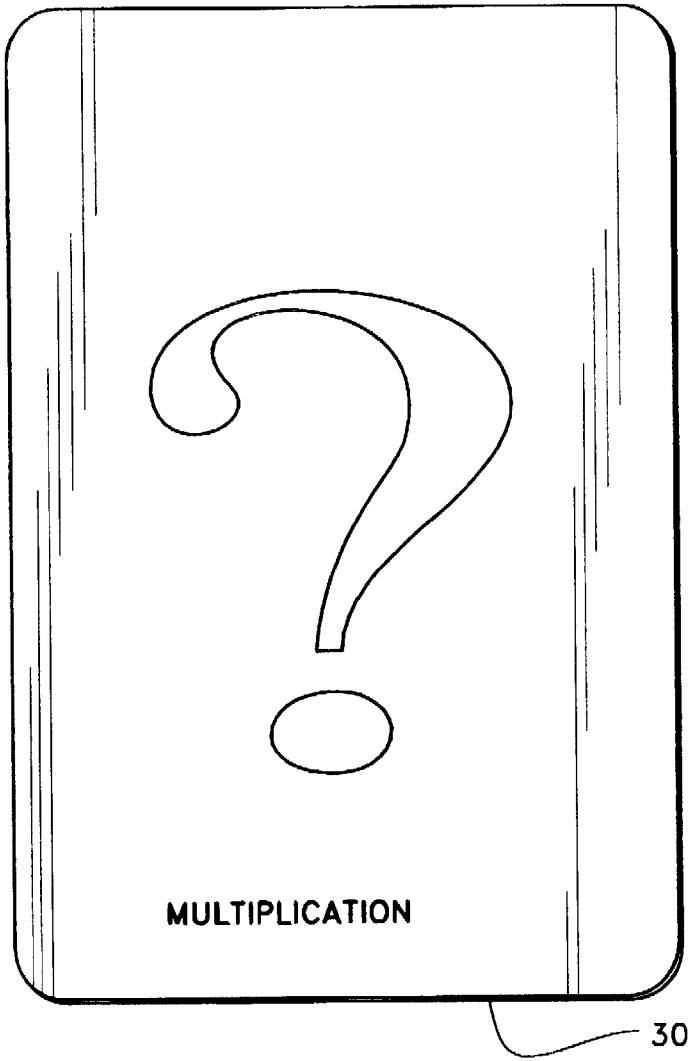
FIG. 5A is a view of an exemplary mathematical operation card used in second level play of the present game.

The game board 10 further includes an arithmetic table card or mathematical problem card position 16, for an arithmetic table card (FIGS. 4A and 4B) or a mathematical problem card (FIG. 5B). The operation space 18 is provided for an operation card (FIG. 5A). The function of these cards is discussed further below.

A plurality of player position markers 20 is also provided, with each player using one of the markers 20 to mark his or her progress along the playing path 12 of the game board 10. Each of the markers 20 is preferably raised, in order to provide a better grip for handling the markers 20, and includes a pattern or representation thereon, either flat or in relief. The pattern of each marker 20 is distinct from each other marker 20, so that each player has a unique marker 20 to mark his or her progress about the board 10 during the play of the game. Other types of markers (small models or representations of various articles, etc.) may also be used, as desired.

Figure 7:
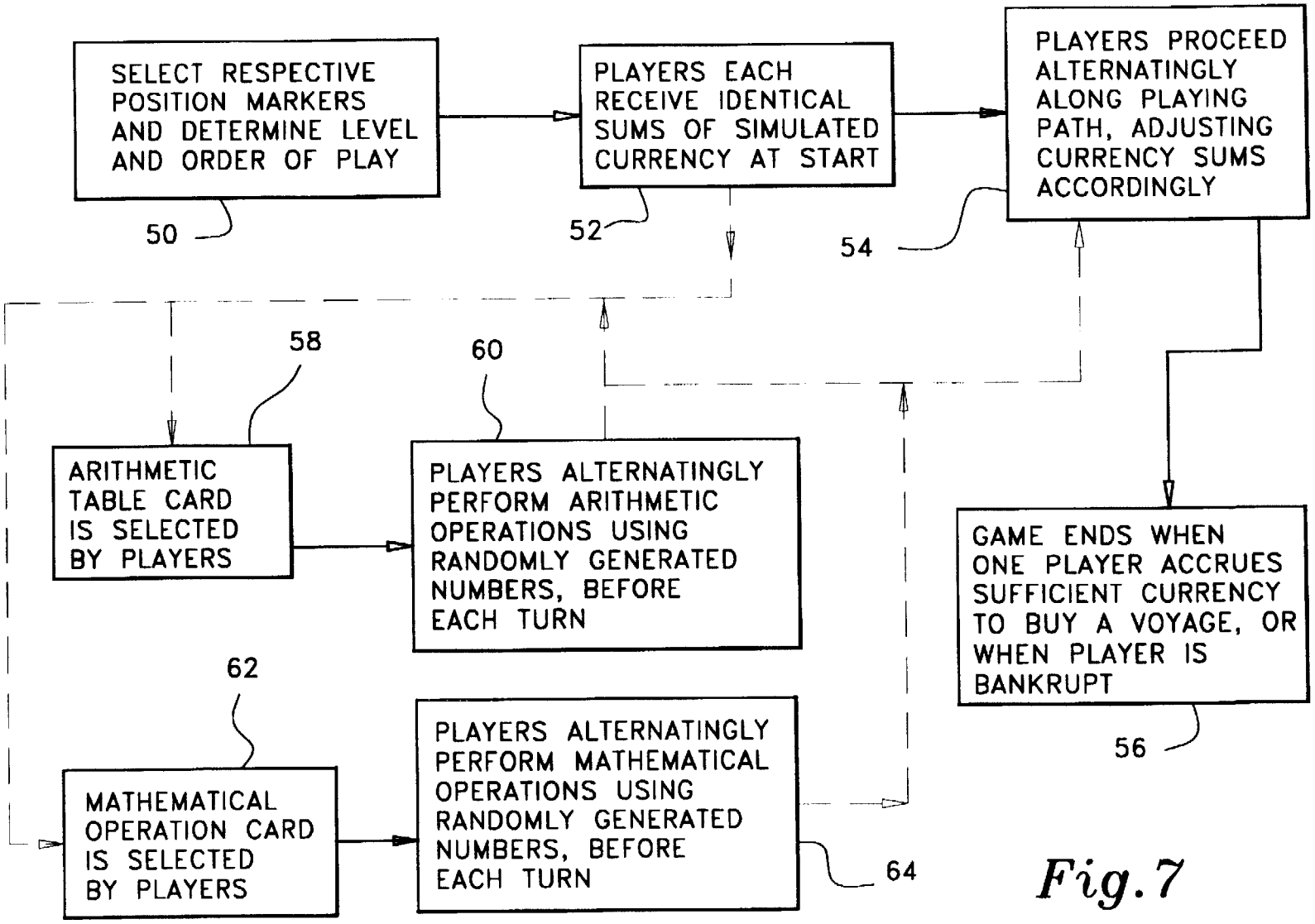
FIG. 7 is a block diagram showing the general steps in the method of play of the present game.

The game is initiated by allowing the players to select individual player position markers 20, and determining the order of play, as indicated by the first step 50 in the method of play diagram of FIG. 7. The chance means used in the play of the present game may be used to determine the order of play, as well as for determining the distance of each player's move and other factors in the game. Conventional cubical dice, having their six faces each numbered from one to six, have been found to work well as random number generation means for the present game, but other random number generation means may be used as well, if desired.

The players will also determine the level at which the present game is to be played at this step, before starting the game. This is done by mutual consensus of the players. As noted above, the present game may incorporate up to three different levels, with younger children only beginning to gain a grasp of numbers, likely choosing to remain at the first level of the game.

Figure 6A:
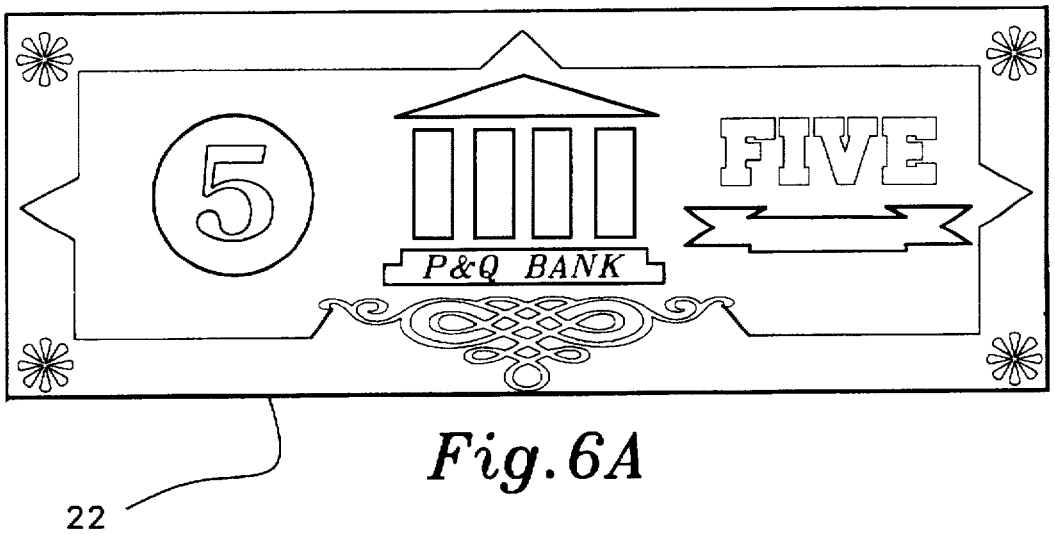
FIG. 6A is a front view of a first denomination of simulated currency used in the present game.
Figure 6B:
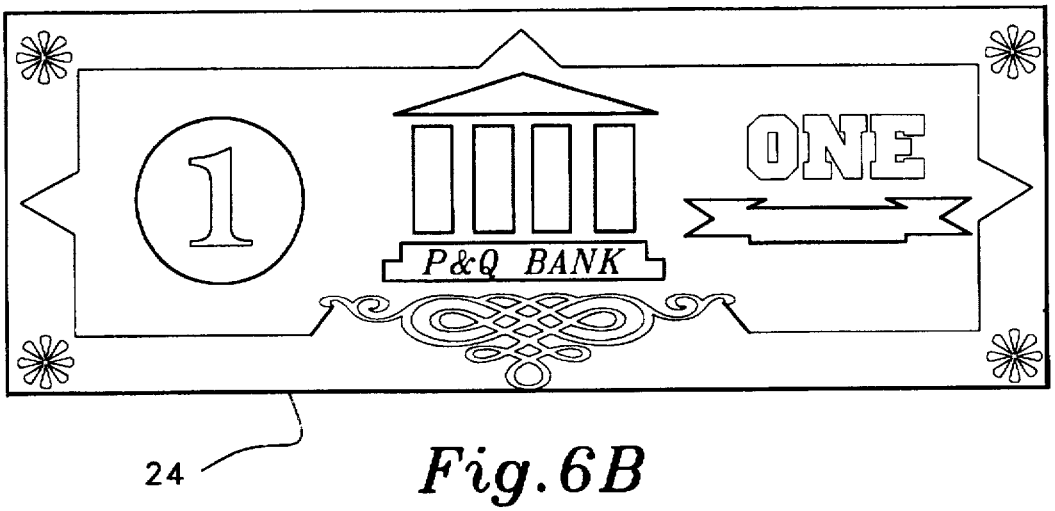
FIG. 6B is a front view of a second denomination of simulated currency used in the present game.

Once the player position markers, order of play, and level of play have been determined, and the "allowance" of simulated currency has been provided as indicated by the second step 52 of FIG. 7, the first player tosses two dice and uses their combined total to determine the rest position of his or her player position marker 20 for that move. Assuming one die turned up a four, and the second die turned up a three, the player would move his or her position marker 20 seven positions, to the position 14*d*, "Pay $2.00 for a video." The player would pay $2.00 of the $10.00 received as "allowance" at the beginning of the game. (Simulated currency in $5.00 and $1.00 denominations, respectively indicated by the reference numerals 22 and 24, are shown respectively in FIGS. 6A and 6B.) The game may also be used to teach children to make change, if it is necessary for the player to change a larger denomination during play.

At the first level of play, play continues in the above manner, with each of the players alternating turns and paying out or receiving payment according to each of the board positions 14 upon which their markers are placed according to their respective moves. This is indicated by the third step 54 of FIG. 7.

The goal of the present game is to be the first player to accrue sufficient funds using the simulated currency 22 and 24 of the present game, to provide for the purchase of an imaginary trip or voyage to a distant locale. The cost of such an imaginary trip is $30.00, by the present rules. A review of all of the player positions 14 about the board periphery will show that adding and subtracting the monetary amounts of each of the positions 14 in one lap around the board 10, results in a net increase of $19.00 (or $29.00, if the starting position 14*a* is counted at the beginning of the second lap). As the average move using two conventional dice will be about seven positions, it will be seen that it will take approximately seven laps around the board 10 for a player to accrue $30.00 in the simulated currency used in the present game, to purchase such an imaginary trip. This is reasonable, considering the relatively short attention span typical of small children playing the present game at the first level. Other amounts and scenarios may be used for the playing positions 14 of the board 10, and the cost of the "voyage," as desired, to shorten or lengthen the game as desired.

Figure 3B:
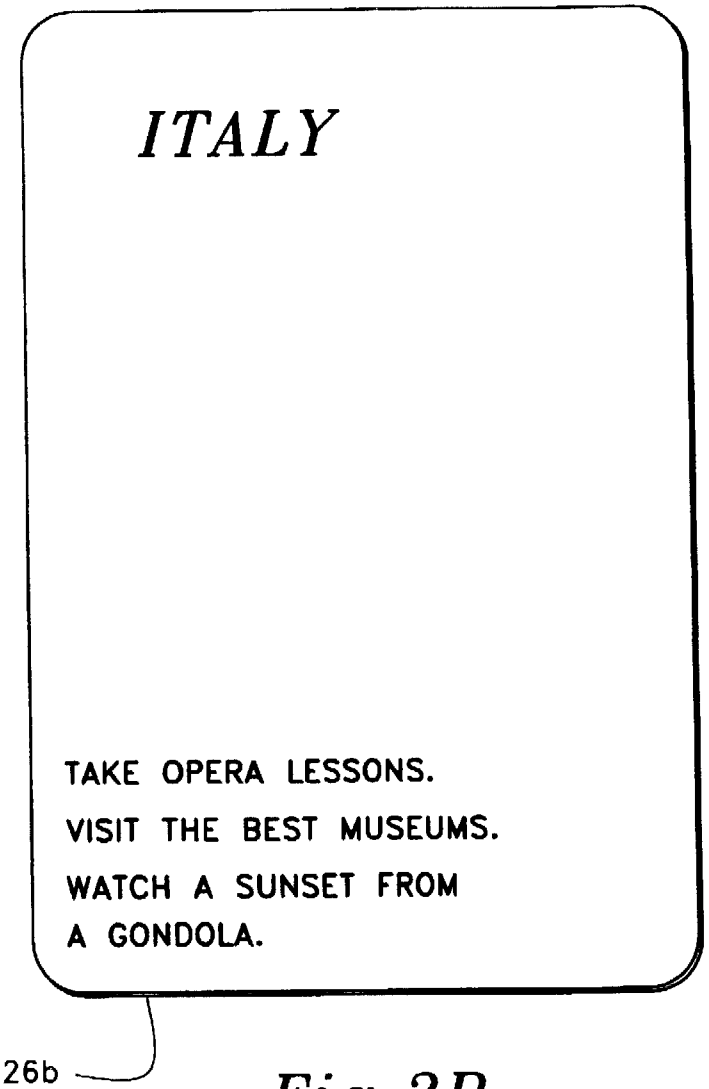
FIG. 3B is a back view of the card of FIG. 3A.
Figure 3A:
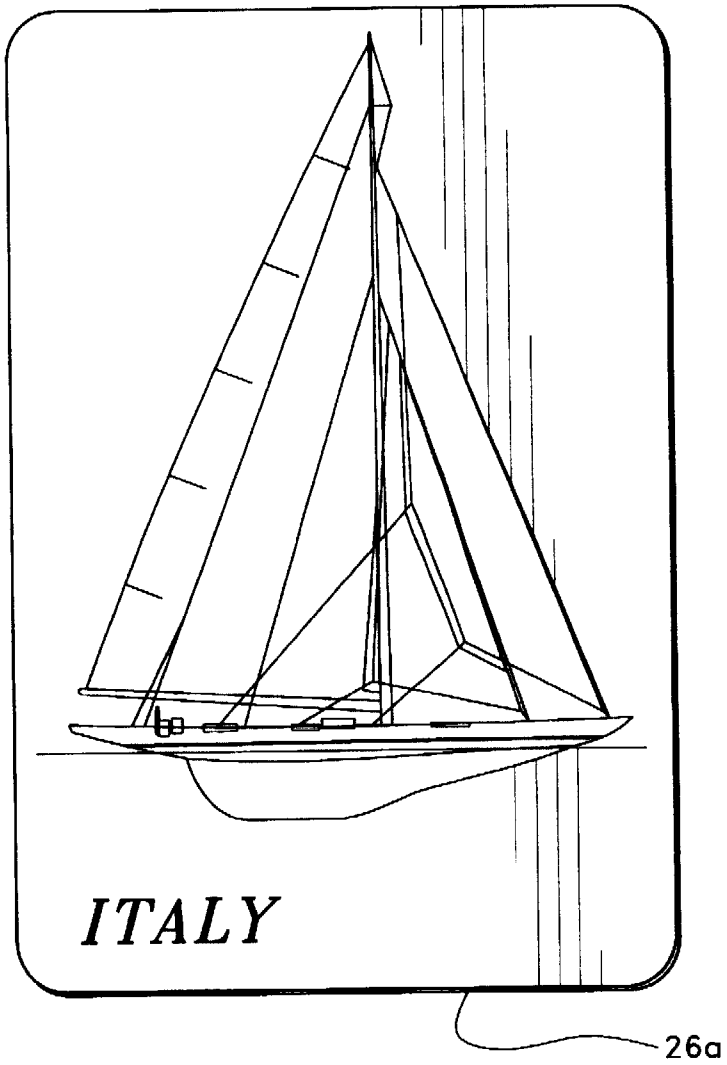
FIG. 3A is a front view of an exemplary voyage card used in the present game to reward winning players.

When a player has accrued a total of at least $30.00 in simulated currency, he or she may make such a purchase of a simulated voyage. The purchase of such a voyage by a player ends the game, at least at the first level of play, as indicated in the fourth step 56 of FIG. 7. The player is given a simulated travel or "voyage" card, with an example of the front and rear faces 26*a* and 26*b* of such a card shown respectively in FIGS. 3A and 3B.

Each card may also have a representation on the front face 26*a* of the geographical area relating to the trip or voyage. Examples of such travel or "voyage" cards are shown below:

TABLE 1

SIMULATED TRAVEL CARDS

| FRONT FACE | REAR FACE |
|---|---|
| New York | View a Broadway show. Visit the Statue of Liberty. Eat in a five star restaurant. |
| Machu Picchu | Take an archeological expedition to Machu Picchu. Explore the rain forest for giant butterflies. |
| Malaysia | Paint a sunset. Sail to a remote island. Participate in an archeological dig. |
| China | Walk the Great Wall. Visit the Tomb of Buried Soldiers. Sail a junk to Beijing. |
| Egypt | Study hieroglyphics at the great pyramids. Sail a boat the length of the Nile. |
| France | Visit the Louvre. Paint. Climb the Eiffel Tower. Participate in the Tour de France. |

Any one of a number of additional travel cards may be provided, as desired; the above described cards are exemplary, and the present game is not limited only to the cards specifically described in the above table.

The game described thus far is at its simplest level, with no other arithmetic or mathematical operations being required other than the relatively simple addition and subtraction required according to the specific instructions of each of the positions 14 about the periphery of the board 10. However, the present game also provides for more complex levels of play, as described below.

If the players desire a somewhat more advanced game, they may mutually agree to play at the next or second level of play, wherein one of several arithmetic table cards is selected at the beginning of the game, as indicated by the optional fifth step 58 of FIG. 7. The front face 28*a* and opposite rear face 28*b* of an exemplary arithmetic table card are shown respectively in FIGS. 4A and 4B of the drawings. The front face of each of the cards has some pictorial representation (e. g., three coins, as in the card front face 28*a* of FIG. 4A) of the base number to be used in each of the arithmetic problems of the card. Preferably, a plurality of cards are provided, with base operative numbers ranging from one to twelve, or higher as desired. A table describing other such cards follows:

TABLE 2

| ARITHMETIC CARDS | |
|---|---|
| CARD NUMBER | ARITHMETIC OPERATION |
| 2 | 2 plus 1 equals 3 |
| | 2 plus 2 equals 4 |
| | 2 plus 3 equals 5 |
| | 2 plus 4 equals 6 |
| (the balance of the center of the card is omitted for brevity) | |
| | 2 times 9 equals 18 |
| | 2 times 10 equals 20 |
| | 2 times 11 equals 22 |
| | 2 times 12 equals 24 |
| | ***** |
| 7 | 7 plus 1 equals 8 |
| | 7 plus 2 equals 9 |
| | 7 plus 3 equals 10 |
| | 7 plus 4 equals 11 |
| (the balance of the center of the card is omitted for brevity) | |
| | 7 times 9 equals 63 |
| | 7 times 10 equals 70 |
| | 7 times 11 equals 77 |
| | 7 times 12 equals 84 |

As noted above, the arithmetic addition operations from 5 to 12, and the arithmetic multiplication operations from 1 to 8, have been omitted in each of the above examples for brevity. The arithmetic operation cards 1, 4, 5, 6, 8, 9, 10, 11, and 12 used with the present game are not shown, but will be understood to be similar in format to the 3 card shown in FIGS. 4A and 4B, and the 2 and 7 cards shown partially in Table 2 above. The above cards may also include subtraction and division operations if so desired.

The present game at its second or intermediate level is played beginning with the same steps as described above for beginning the first level of play, i. e., selecting position markers, determining order of play, and collecting an "allowance" at the start. However, before play begins, the players mutually select one of the arithmetic table cards 28*a*/28*b* described above, and place it on the arithmetic table card area 16 of the board 10, preferably with the first side or face 28*a* facing upwardly to provide a pictorial representation of the numerical factor to be used during play at this level. The players also mutually decide on the type of arithmetic operation (addition, subtraction, multiplication, or division) to be required by each player during this step, and place an operation card, such as the multiplication card 30 shown in FIG. 5A, on the operation area 18 of the board 10 as a reminder of the type of arithmetic operation to be accomplished by each player during that player's turn. This operation card 30 may also be used at the third or highest level of the game to indicate the type of mathematical operation to be performed at that level.

Before each player is allowed to toss the dice to make a move along the playing path 12 of the board 10, that player is required to toss the dice to generate a random number for use with the arithmetic table card 28 which has been placed upon the arithmetic table card position 16 of the board 10. A second pair of dice other than the dice pair used to determine each move of the players may be used as the random number generation means, or the same pair of dice may be used for both operations.

As an example of the above, let us assume that the card 28*a*/28*b* of FIGS. 4A and 4B has been placed in the first position 16 of the board 10, with the face 28*a* of the card (FIG. 4A) being positioned to face upwardly. Thus, three coins (or other articles, as desired) are visible to all players. An operation card, e. g., the multiplication card 30 of FIG. 5A (which may comprise an opposite face to the mathematical operation card of FIG. 5B), is placed in the second position 18 of the board 10 to indicate the type of mathematical operation (e. g., multiplication, as shown at the bottom of the card 30 of FIG. 5A) is to be conducted.

Before rolling the dice to determine positional advancement about the playing path 12 of the board 10, the dice are tossed to provide a number totaling between two and twelve. (The card 28*b* provides problems and solutions down to one, in the event a single die is used.) The player must provide the correct answer to the arithmetic problem posed by the number shown on the dice, the factor shown on the card face 28*a* of position 16, and the mathematical operator shown on the card face 30 of position 18.

As an example of the above, assume that the player rolls a two on one of the dice, and a four on the second die. The player must perform a simple addition problem, similar to those involved in the first or lowest level of the game, to arrive at the total of six for the two dice. This number is then used as the variable for the problem, which is manipulated by using the mathematical operator (multiplication) shown on the card 30 placed on the second position 18 of the board 10, to multiply the variable (six) by the constant (three) shown on the face 28*a* of the card which has been placed on the first position 16 of the board 10. When the player arrives at a solution, the card 28*a* may be momentarily turned up to expose the table side 28*b*, where the solution is checked for accuracy.

Assuming the player arrived at the correct solution of eighteen, he or she may then roll the dice again (or use a second pair) to determine the positional advance of that player's position marker 20 along the playing path 12 of the board 10. In the event of an incorrect answer, the player is not allowed to roll the dice for positional advance of his or her position marker 20; the player's position marker must remain in place until that player's turn comes up again. The above described play at the second or intermediate level of the game is described generally in the optional sixth step 60 of the block diagram or flow chart of FIG. 7, showing the general method of play of the present game.

Play continues in the above manner, alternating between players in an orderly manner, until one of the players has accrued the predetermined sum required to purchase a "voyage" and done so to end the game, at least at that level. Alternatively, the game ends when one player is bankrupt and has paid out all simulated currency issued to that player during the course of play, as indicated by the fourth step 56 of the FIG. 7 diagram.

The third or highest level of the present game is an optional level which may be added to the previous two levels discussed above, as desired and by mutual consent of all players. When the third level of play is used, the game is played using the first two levels, with the winner of each level being the first player to accrue the predetermined amount (e. g., $30) of simulated currency and purchases a voyage card for an imaginary voyage. When the second level of play has been completed, players select one of the mathematical operation cards 32, an example of which is shown in FIG. 5B, for placement on the first position 16 of the board 10, as indicated in the optional seventh step 62 of FIG. 7. These cards both indicate the type of mathematical operation(s) to be performed, and also instruct the player as to the quantity of random numbers to be generated to arrive at the proper number of variables required for the given mathematical operation of any one specific card. Table 3 below provides additional examples of such mathematical operation cards.

TABLE 3

| MATHEMATICAL OPERATION CARDS | |
|---|---|
| 1. (Addition) | Throw three dice. Throw two dice. Add them. |
| 2. (Addition) | Throw four dice. Throw one die. Add them. |
| 3. (Subtraction) | Throw three dice. Throw one die. Subtract the single die from the total of the three dice. |
| 4. (Subtraction) | Throw four dice. Throw one die. Subtract the single die from the total of the three dice. |
| 5. (Multiplication) | Throw one die. Throw a second die. Multiply the two numbers together. |
| 6. (Multiplication) | Throw two dice. Throw a third die. Add the first two dice together, and multiply by the third. |
| 7. (Division) | Throw three dice. Throw a single die. Add the first three dice together, and divide by the single die. |
| 8. (Division) | Throw four dice. Throw a single die. Add the first four dice together, and divide by the single die. |

It will be seen that the above described cards are exemplary, and that many more such cards may be provided for the play of the present game, as desired. Also, it will be noted that some of the above examples require up to five dice in order to generate a sufficient quantity of random numbers to meet the requirements of the specific problem. Accordingly, the present game may include five dice, in order to facilitate play. However, it will be seen that repetitive throwing of a smaller number of dice, or a single die, may be used to generate the required numbers, if so desired.

Preferably, a mathematical operator card, such as the card 30 of FIG. 5A, is placed on the second position 18 of the board 10, as a reminder of the type of operation (addition, subtraction, multiplication, or division) required by the card 32 of FIG. 5B. As plural cards 32 are provided, the mathematical operator 30 and operation card 32 may be provided on opposite sides of the same card, with a second card having the proper operator indication being turned to place the operator side 30 facing upwardly on the second position 18 of the board 10. However, it will be seen that this step is not required, as each of the mathematical operation cards 32 includes the specific mathematical operation to be performed for that particular problem.

Assuming that all players have agreed to include play at the third or highest level of the game, a mathematical operation card, e. g., the card 32 of FIG. 5B, is selected for placement on the first position 16 of the board 10 after play at the first two levels has been completed, as described generally in the optional seventh step 62 of FIG. 7. A card having the proper mathematical operation shown thereon, e. g., the card 30 of FIG. 5A, may be placed on the second position 18 of the board 10 as a reminder of the type of operation to be performed.

As in the second level of play, a player must generate one or more random numbers which are then manipulated according to the instructions of the face up card (e. g., card 32) which has been placed on the first position 16 of the board 10. Using the example of the card 32 of FIG. 5B, the player must toss two dice, and multiply their two numbers together. The player may not toss the dice again to determine a positional move until he or she arrives at a correct answer for the problem of the card 32, using the variables provided by the random number generation means. This is indicated generally in the optional eighth step 64 of FIG. 7.

It is intended that the present game be usable by relatively small children, or by persons with practically no numerical skills. Accordingly, it is preferred that some means of verifying the responses of players to such problems as described above, be provided. While no specific tables are provided with proper responses to operations such as the one described immediately above, it will be seen that other cards, such as the table shown on the card face **28*b* of FIG. 4B, provide the proper answers to most of the problems which will come up during the third level of play. These cards may be used as desired to check on the responses of players at the third level of play. A player achieving a correct response may then roll two dice to determine a positional advance, in the manner of play at the first two levels of the game. The end of the game is determined as in the case of the other two levels, with the first player to accrue a predetermined sum, purchasing a voyage card 26** to end the game, or with the first player to lose all of his or her simulated currency ending the game at that point.

In summary, the present board game will be seen to provide a most enjoyable means of teaching small children and others who have poor arithmetic and basic numerical skills, the rudiments of such skills. The three levels of the game enable players of virtually any skill level to sharpen their arithmetic and mathematical skills, while still enjoying a pleasant, competitive board game.

It is to be understood that the present invention is not limited to the sole embodiment described above, but encompasses any and all embodiments within the scope of the following claims.

We claim:

1. A board game for a plurality of players, comprising:

A game board having a continuous peripheral playing path;

said playing path being divided into a plurality of contiguous playing positions;

each of said playing positions including instructions for transacting a monetary exchange;

said game board further including a first location for holding a single arithmetic table card and a second location for holding a single mathematical problem card;

random number generation means for alternatingly determining one of said playing positions for each of the players and for providing numbers for arithmetic problems and for mathematical operations for the players;

at least one arithmetic table card for indicating a type of arithmetic problem to be performed and for verifying a solution to an arithmetic problem, said arithmetic problem having a number corresponding to numbers generated by said random number generator;

at least one mathematical operation card for indicating a type of mathematical operation to be performed and for indicating the quantity of numbers to be provided by said random number generation means for the mathematical operation;

a plurality of individual player position markers; and a quantity of simulated currency having at least a first denomination and a second denomination.

2. The board game according to claim 1, including a plurality of simulated travel cards for rewarding a winning player by simulating a trip.

3. The board game according to claim 1, wherein said playing positions include a first group of positions providing payment for players reaching any one of said first group of positions, and a second group of positions requiring payment from players reaching any one of said second group of positions.

4. The board game according to claim 1, wherein said at least one arithmetic table card comprises a plurality of cards each including a plurality of arithmetic problems and providing at least one distinct numerical factor.

5. The board game according to claim 1, wherein said at least one mathematical operation card comprises a plurality of cards each requiring at least two numbers to be generated randomly and further requiring at least one mathematical operation.

6. The board game according to claim 1, wherein said random number generation means comprise a plurality of dice.

7. The board game according to claim 6, wherein said plurality of dice comprise five dice.

8. A method of playing a board game, comprising the following steps:

(a) providing a game board having a continuous peripheral playing path divided into a plurality of contiguous playing positions, with each of said playing positions including instructions for transacting a monetary exchange;

(b) further providing a first location for holding a single arithmetic table card and a second location for holding a single mathematical problem card on the game board;

(c) further providing random number generation means for alternatingly determining one of the playing positions for each of the players and for providing numbers for arithmetic problems and for mathematical operations for the players;

(d) further providing at least one arithmetic table card for indicating a type of arithmetic problem to be performed and for verifying a solution to the arithmetic problem, said arithmetic problem having a number corresponding to numbers generated by said random number generator, and at least one mathematical operation card for indicating a type of mathematical operation to be performed and for indicating the quantity of numbers to be provided by the random number generation means for the mathematical operation;

(e) further providing a plurality of individual player position markers, and a quantity of simulated currency having at least a first denomination and a second denomination;

(f) further providing a plurality of cards representing simulated pleasure trips;

(g) establishing different levels of play from a lowest level to a highest level, with the levels requiring increasingly complex arithmetic and mathematical operations by the players of the game, from the lowest level to the highest level;

(h) determining the levels of play to be used during the game;

(i) selecting individual player position markers, determining the order of play by the players, and providing each of the players with an identical sum of the simulated currency;

(j) alternatingly using the random number generation means for determining the move of each player position marker in turn to one of the playing positions along the playing path of the game board, and moving each player position marker accordingly;

(k) if one of said higher levels of play is chosen, alternatingly drawing an arithmetic table card or drawing a mathematical operation card, generating at least one random number using the random number generator means, and using the random number to solve the arithmetic problem or mathematical operation;

(l) alternatingly transacting monetary exchanges according to the instructions of the playing positions to which each of the player position markers have been moved; and (m) ending the game according to the amount of simulated currency accrued by one of the players.

9. The method of playing a board game according to claim 8, including the step of:

(a) providing a first group of positions providing payment for players reaching any one of the first group of positions; and (b) providing a second group of positions requiring payment from players reaching any one of the second group of positions.

10. The method of playing a board game according to claim 8, wherein the step of ending the game comprises a first one of the players accruing a predetermined amount of the simulated currency to win the game.

11. The method of playing a board game according to claim 8, wherein the step of ending the game comprises a first one of the players going bankrupt and paying out all of the simulated currency accrued by that player.

12. The method of playing a board game according to claim 8, including the steps of:

(a) selecting an intermediate level of play;

(b) drawing an arithmetic table card at the beginning of the game, and placing the card on the first location of the board;

(c) generating at least one random number at each player's turn using the random number generation means;

(d) having the player solve the arithmetic problem of the card by using the at least one random number generated; and (e) using the random number generation means for determining the move of the player position marker for the player successfully solving the problem, to one of the playing positions along the playing path of the game board, and moving the player position marker accordingly.

13. The method of playing a board game according to claim 8, including the steps of:

(a) selecting a highest level of play;

(b) drawing a mathematical operation card at the beginning of the game, and placing the card on the second location of the board;

(c) generating a plurality of random numbers at each player's turn according to the card, using the random number generation means;

(d) having the player perform a mathematical operation by manipulating the random numbers generated in accordance with the operation indicated on the card; and (e) using the random number generation means for determining the move of the player position marker for the player successfully performing the mathematical operation, to one of the playing positions along the playing path of the game board, and moving the player position marker accordingly.

14. The method of playing a board game according to claim 8, including the step of providing a plurality of dice for the random number generation means.

15. The method of playing a board game according to claim 8, including the step of providing five dice for the random number generation means.

* * * * *